United States Patent [19]

Kamosaki et al.

[11] Patent Number: 4,990,486

[45] Date of Patent: Feb. 5, 1991

[54] THERMAL TRANSFER IMAGE RECEIVING MATERIAL

[75] Inventors: Tetsu Kamosaki, Kanagawa; Toshiaki Inaba, Ishikawa, both of Japan

[73] Assignee: Fuji Photo Film Co., Ltd., Kanagawa, Japan

[21] Appl. No.: 433,869

[22] Filed: Nov. 9, 1989

[30] Foreign Application Priority Data

Nov. 11, 1988 [JP] Japan ..... 63-285172
Feb. 27, 1989 [JP] Japan ..... 63-43126

[51] Int. Cl.[5] ..... B41M 5/035; B41M 5/26

[52] U.S. Cl. ..... 503/227; 8/471; 428/195; 428/341; 428/342; 428/480; 428/913; 428/914

[58] Field of Search ..... 428/195, 480, 913, 914, 428/341, 342; 503/227; 8/471

[56] References Cited

U.S. PATENT DOCUMENTS 4,097,230 6/1978 Sandhu ..... 428/480

FOREIGN PATENT DOCUMENTS 59-101395 11/1984 Japan ..... 503/227

*Primary Examiner*—Bruce H. Hess
*Attorney, Agent, or Firm*—Sughrue, Mon, Zinn, Macpeak & Seas

[57] ABSTRACT

A thermal transfer image receiving material is disclosed comprising a support having thereon at least one dye image receiving layer containing a polyester resin containing anionic groups and containing phenylene groups in the linear chain of the resin.

5 Claims, No Drawings

THERMAL TRANSFER IMAGE RECEIVING MATERIAL

FIELD OF THE INVENTION

The present invention concerns a thermal transfer image receiving material for thermal transfer recording, and in particular concerns a thermal transfer image receiving material which provides excellent image density and image storage properties.

BACKGROUND OF THE INVENTION

A variety of information processing systems have been developed as a result of the rapid development which has taken place in the information industry in recent years, and methods and apparatus for recording compatible with these information systems have been developed and put to practical use. The thermal transfer recording method which is one such recording method involves the use of light weight equipment which is compact and noise free, and has excellent operability and maintenance characteristics. Moreover, since the method enables colors to be used easily, it is being used in a wide range of applications. Thermal transfer recording methods can be broadly classified into two types, namely the thermofusible type and the thermomobile type. In the latter case, a thermal transfer dye donating material having a dye donating layer containing a binder and thermomobile dye on a support is laminated with a thermal transfer image receiving material. Heat is applied from the support side of the dye donating material, and the thermomobile dye is transferred in the form of a pattern corresponding to the heat pattern which has been applied to the recording medium (the thermal transfer image receiving material) to provide a transfer image. Here, the term "thermomobile dye" signifies a dye which is transferable from the thermal transfer dye donating material to the thermal transfer image receiving material by sublimation or by diffusion in a medium.

However, the images obtained using conventional thermal transfer image receiving materials have inadequate density and the image is susceptible to blurring on storage. There is a further disadvantage in that the image receiving layer is liable to peel away from the support, such that these materials are unsatisfactory as hard copy materials.

SUMMARY OF THE INVENTION

The above noted problems have been overcome by means of thermal transfer image receiving material comprising a support having thereon at least one dye image receiving layer containing a polyester resin containing anionic groups, and containing phenylene groups in the linear chain portion of the resin.

DETAILED DESCRIPTION OF THE INVENTION

Any support which is able to withstand the transfer temperature, and has the appropriate smoothness, whiteness, slip properties, wear properties, anti-static properties and post transfer indentation properties, can be used as the support in the thermal transfer image receiving material of the present invention. Useful examples of such supports include synthetic paper supports (such as polyolefin and polystyrene based synthetic papers), paper supports such as top quality paper, art paper, coated paper, cast coated paper, wall paper, lining paper, synthetic resin or emulsion impregnated paper, synthetic rubber latex impregnated paper, synthetic resin added paper, cardboard, cellulose fiber paper, polyolefin coated paper (especially papers which have been coated on both sides with polyethylene), various plastic films or sheets such as films of polyolefins, poly(vinyl chloride), poly(ethylene terephthalate), polystyrene, methacrylate or polycarbonate, and films or sheets in which these plastics have been treated in such a way as to provide them with white reflection properties. Laminates obtained with optional combinations of the above noted supports can also be used.

One or more image receiving layers for dyes are established on the thermal transfer image receiving material of the present invention. The image receiving layer is a layer which takes up the dye which migrates from the thermal transfer dye donating material during printing and is dyed thereby.

In the present invention, a polyester resin containing anionic groups and containing phenylene groups in the linear chain portion of the resin is used for the image receiving layer. Here, the term "anionic group" signifies a group which exhibits an anionic nature in the polyester resin, and those anionic groups which take the form of salts (Na salts, K salts or $NH_4$ salts, for example) are preferred.

(1) Polyesters containing anionic groups can be broadly classified into those having anionic groups in the dicarboxylic acid component from which the polyester is derived, and those in which the anionic group is included in the diol component from which the polyester is derived. The preferred anionic groups are, for example, $—COO^{\theta}$, $—SO_3^{\theta}$ and $—O^{\theta}$, with more preferred anionic groups being $—COO^{\theta}$ and $—SO_3^{\theta}$.

Nonlimiting examples of units constituting the linear chain portion of the polyester of the present invention containing anionic groups are indicated below. The anionic groups in these examples are represented by sulfonic acid groups, but a similar effect is achieved using other anionic groups.

(i) Nonlimiting examples of units containing the anionic group derived from dicarboxylic acid components are indicated below.

An anionic group present in a unit derived from isophthalic acid:

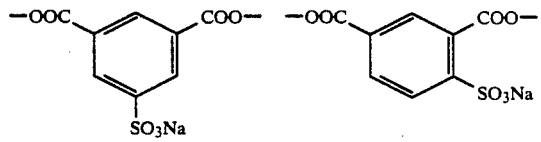

An anionic group present in a unit derived from terephthalic acid:

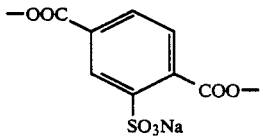

An anionic group present in a unit derived from a long chain dicarboxylic acid (—OCO—(CH-$_2$)—COO—, where n is at least 3):

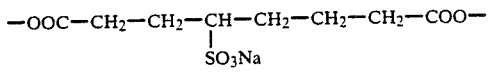

(ii) Nonlimiting examples of units containing an anionic group derived from diol components are indicated below.

An anionic group present in a unit derived from bisphenol A:

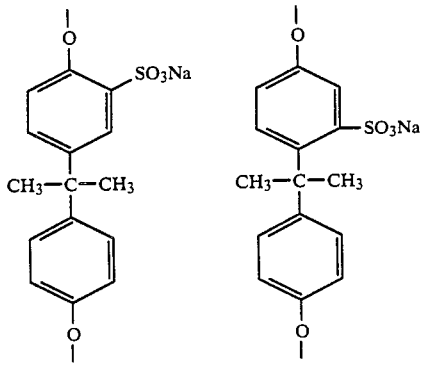

An anionic group present in a unit derived from a long chain diol ($-O-(CH_2)_n-O-$, where n is at least 3).

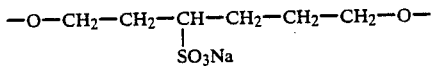

(2) The polyesters containing phenylene groups in the linear chain portion thereof can be broadly classified into those wherein the phenylene groups are present in units derived from dicarboxylic acid components, and those in which the phenylene group is present in units derived from diol components.

(i) Nonlimiting examples of units wherein the phenylene group is present in the linear chain portion of the polyester derived from a dicarboxylic acid are indicated below.

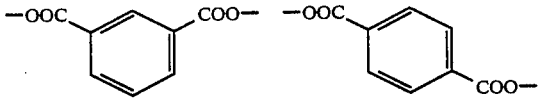

(ii) Nonlimiting examples of diols wherein the phenylene group is present in the linear chain portion of the polyester derived from a diol are indicated below.

Bisphenol A
Bisphenol B
Bisphenol AF
Bisphenol S

Polyester resins derived from the above noted dicarboxylic acid components and diol components randomly and arbitrarily combined, are effective in the present invention.

The use of polyesters in which phenylene groups are present in the units constituting the linear chain portion thereof derived from diol components is especially desirable in the present invention. In this case, the unit containing phenylene groups derived from diol components constitute from 5 to 100 mol %, and most desirably from 10 to 80 mol % of the total units derived from diol components.

Moreover, the use of polyesters in which phenylene groups are present in the units derived from diol components and anionic groups are present in the units derived from dicarboxylic acid components is preferred. In such a case, the amount of the units containing phenylene groups derived from the diol components is preferably in the proportion indicated above, and the units containing anionic groups derived from dicarboxylic acid components constitute from 0.1 to 20 mol %, and most desirably from 0.2 to 10 mol % of the total units derived from dicarboxylic acid components.

Diol components (for example, ethylene glycol, ester glycol) and dicarboxylic acids (for example, sebacic acid) having no anionic groups or having no phenylene groups present in the resulting linear polyester chain can be used in addition to the above noted diol and dicarboxylic acid components when forming a polyester resin of the present invention.

Preferred polyester resins of the present invention are indicated below, but the invention is not limited thereto.

| Resin No. | TPA | IPA | SIPA | BIS-A-ED | EG | EsG | BIS-S-ED |
|---|---|---|---|---|---|---|---|
| 1 | 25 | 25 | 1 | 24.5 | 24.5 | — | — |
| 2 | 25 | 25 | 2 | 24 | 24 | — | — |
| 3 | 25 | 25 | 3 | 23.5 | 23.5 | — | — |
| 4 | 24.5 | 24.5 | 1.4 | 35 | 15 | — | — |
| 5 | 23.5 | 23.5 | 3 | 25 | 25 | — | — |
| 6 | 23.8 | 23.8 | 2.4 | 30 | 20 | — | — |
| 7 | 24.3 | 24.3 | 1.4 | — | 25 | 25 | — |
| 8 | 24.3 | 24.3 | 1.4 | — | 25 | — | 25 |
| 9 | 24.5 | 24.5 | 1 | 40 | 10 | — | — |
| 10 | 23.5 | 23.5 | 3 | 35 | 10 | — | — |
| 11 | 23.5 | 23.5 | 3 | 40 | 5 | 5 | — |
| 12 | 23.5 | 23.5 | 3 | 45 | 5 | — | — |

The numerical values in the table above indicate the polyester composition (mol %), and the designations TPA, IPA, SIPA, BIS-A-ED, EG, EsG and BIS-S-ED represent either components from which the units of the polyester are derived from, or represent units of the polyester (e.g., SIPA), and these designations are defined below as follows.

TPA: Terephthalic acid

IPA: Isophthalic acid

SIPA: 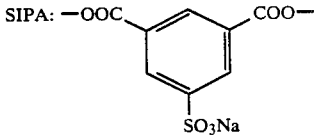

-continued

BIS-A-ED HO—$(CH_2)_2$—O

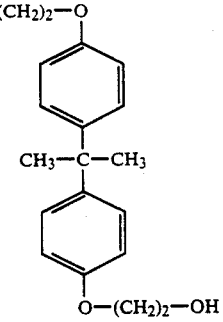

EG: Ethylene glycol

EsG: $HO-CH_2-C(CH_3)_2-CH_2-O-C(=O)-C(CH_3)_2-CH_2-OH$

BIS-S-ED HO—$(CH_2)_2$—O

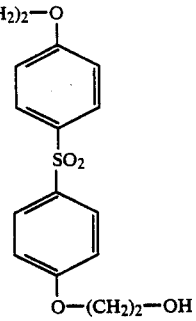

The polyester resins of the present invention can be prepared by the condensation polymerization reactions known in the art.

The polyester resins of the present invention are preferably coated in an amount of from 1 gram to 100 grams per square meter of the support.

Mixtures of these resins can be used in the present invention, and mixtures of these resins with other known dye accepting resins can also be used. Examples of the dye accepting resins include polyester, polyvinyl chloride acetate, polycarbonate, polymethyl methacrylate and polystyrene.

The image receiving layer may be a single layer, or two or more such layers may be provided on the support. The overall thickness of the image receiving layer is from 1 to 50 μm, and preferably from 3 to 30 μm.

High boiling point organic solvents or thermal solvents can be included in the thermal transfer image receiving material and especially in the at least one image receiving layer of the present invention, as substances which can accept or dissolve the thermomobile dyes or as diffusion promotors for the dyes.

Useful examples of such high boiling point organic solvents and thermal solvents include the compounds disclosed, for example, in JP-A-No. 62-174754, JP-A-No. 62-245253, JP-A-No. 61-209444, JP-A-No. 61-200538, JP-A-No. 62-8145, JP-A-No. 62-9348, JP-A-No. 62-30247 and JP-A-No. 62-136646. (The term "JP-A" as used herein means an "unexamined published Japanese patent application".)

The image receiving layers of the thermal transfer image receiving material of the present invention may be formed by dispersing and loading the substances which accept thermomobile dyes in a water soluble binder. A variety of known water soluble polymers can be used as the water soluble binder, but the use of water soluble polymers having groups which undergo a crosslinking reaction with a hardening agent are preferred. Specific examples of the water soluble polymers having groups which undergo a crosslinking reaction with a hardening agent include gelatin and polyvinyl alcohol, and specific examples of the hardening agents include an isocyanate compound, an epoxy compound and formaldehyde.

The thermal transfer image receiving material of the present invention may have one or more intermediate layers between the support and the at least one image receiving layer.

Depending on the material from which they are formed, the intermediate layers may function as cushioning layers, porous layers or dye diffusion preventing layers, or may fulfill two or more of these functions, and they may also serve the purpose of an adhesive, depending on the particular application.

Dye diffusion preventing layers are layers which prevent the thermomobile dye from diffusing into the support. The binders used to form these layers may be water soluble or organic solvent soluble, but the use of water soluble binders is preferred, and especially gelatin, which may also be used as a binder for the aforementioned image receiving layer is most desirable.

Porous layers are layers which prevent the heat which is applied at the time of thermal transfer from diffusing from the image receiving layer to the support to ensure that the heat which has been applied is used efficiently.

Fine powders consisting of silica, clay, talc, diatomaceous earth, calcium carbonate, calcium sulfate, barium sulfate, aluminum silicate, synthetic zeolites, zinc oxide, lithophone, titanium oxide or alumina for example, can be included in the image receiving layers, cushioning layers, porous layers, diffusion preventing layers and adhesive layers, etc. constituting the thermal transfer image receiving material of the present invention.

The thermal transfer dye donating materials employing thermomobile dyes generally comprise a thermal transfer layer containing a dye which is sublimed or rendered mobile by heat and a binder provided on a support. These thermal transfer dye donating materials can be obtained by preparing a coating liquid by dissolving or dispersing a known dye which is sublimed or rendered mobile by heating and a binder resin in an appropriate solvent, coating this liquid to form a thermal transfer layer onto one side of one of known supports for thermal transfer dye donating material purposes in an amount to provide a dry film thickness of, for example, from about 0.2 to about 5 μm, and preferably of from 0.4 to 2 μm, and drying the coated layer.

Any of the known dyes for use in thermal transfer dye donating materials can be used in such a thermal transfer layer, but the use of dyes which have a low molecular weight of from about 150 to 800 is especially desirable in the present invention, and the dyes are selected in consideration of their transfer temperature, hue, light fastness and solubility or dispersibility characteristics in inks and binder resins.

In practice, these dyes include dispersible dyes, basic dyes and oil soluble dyes, but the use of "Sumicron Yellow E4GL", "Dyanics Yellow H2G-FS", "Miketon Polyether Yellow 3GSL", "Kayaset Yellow 937", "Sumicron Red EFBL", "Dyanics Red ACE", "Miketon Polyether Red FB", "Kayaset Red 126", "Miketon Fast Brilliant Blue B" and "Kayaset Blue 136", for example, is preferred.

Furthermore, useful yellow dyes include those disclosed, for example, in JP-A-No. 59-78895, JP-A-No. 60-28451, JP-A-No. 60-28453, JP-A-No. 60-53564, JP-A-No. 61-148096, JP-A-No. 60-239290, JP-A-No. 60-31565, JP-A-No. 60-30393, JP-A-No. 60-53565, JP-A-No. 60-27594, JP-A-No. 61-262191, JP-A-No. 60-152563, JP-A-No. 61-244595, JP-A-No. 62-196186, JP-A-No. 63-142062, JP-A-No. 63-39380, JP-A-No. 62-290583, JP-A-No. 63-111094, JP-A-No. 63-111095, JP-A-No. 63-122594, JP-A-No. 63-71392, JP-A-No. 63-74685 and JP-A-No. 63-74688, useful magenta dyes include those disclosed, for example, in JP-A-No. 60-223862, JP-A-No. 60-28452, JP-A-No. 60-31563, JP-A-No. 59-78896, JP-A-No. 60-31564, JP-A-No. 60-303391, JP-A-No. 61-227092, JP-A-No. 61-227091, JP-A-No. 60-30392, JP-A-No. 60-30694, JP-A-No. 60-131293, JP-A-No. 61-227093, JP-A-No. 60-159091, JP-A-No. 61-262190, JP-A-No. 62-33688, JP-A-No. 63-5992, JP-A-No. 61-12392, JP-A-No. 62-55194, JP-A-No. 62-297593, JP-A-No. 63-74685, JP-A-No. 63-74688, JP-A-No. 62-97886, JP-A-No. 62-132685, JP-A-No. 61-163895, JP-A-No. 62-211190 and JP-A-No. 62-99195, and useful cyan dyes include those disclosed, for example, in JP-A-No. 59-78894, JP-A-No. 60-31559, JP-A-No. 60-53563, JP-A-No. 61-19396, JP-A-No. 61-22993, JP-A-No. 61-31467, JP-A-No. 61-35994, JP-A-No. 61-49893, JP-A-No. 61-57651, JP-A-No. 62-87393, JP-A-No. 63-15790, JP-A-No. 63-15853, JP-A-No. 63-57293, JP-A-No. 63-74685, JP-A-No. 63-74688, JP-A-No. 59-227490, JP-A-No. 59-227493, JP-A-No. 59-227948, JP-A-No. 60-131292, JP-A-No. 60-131294, JP-A-No. 60-151097, JP-A-No. 60-151098, JP-A-No. 60-172591, JP-A-No. 60-217266, JP-A-No. 60-239289, JP-A-No. 60-239291, JP-A-No. 60-239292, JP-A-No. 61-148269, JP-A-No. 61-244594, JP-A-No. 61-255897, JP-A-No. 61-284489, JP-A-No. 61-368493, JP-A-No. 62-132684, JP-A-No. 62-138291, JP-A-No. 62-191191, JP-A-No. 62-255187, JP-A-No. 62-288656, JP-A-No. 62-311190 and JP-A-No. 63-144089.

Furthermore, any of known binder resins conventionally used in thermal transfer dye donating materials as a binder for the dye can be used as the binder resin for the above noted dyes. A binder which is resistant to heat, and which does not impede migration of the dye when heated is normally selected. For example, useful resins include polyamide based resins, polyester based resins, epoxy based resins, polyurethane based resins, polyacrylic resins (for example, poly(methyl methacrylate), polyacrylamide, poly(styrene-2-acrylonitrile), vinyl based resins such as polyvinylpyrrolidone, vinyl chloride based resins (for example, vinyl chloride/vinyl acetate copolymers), polycarbonate based resins, polystyrene, poly(phenylene oxide), cellulose based resins (for example, methyl cellulose, ethyl cellulose, carboxymethyl cellulose, cellulose acetate hydrogen phthalate, cellulose acetate, cellulose acetate propionate, cellulose acetate butyrate, cellulose triacetate), poly(vinyl alcohol) based resins (for example, poly(vinyl alcohol), and partially saponified poly(vinyl alcohol) such a poly(vinyl butyral)), petroleum based resins, rosin derivatives, coumarone/indene resins, terpene based resins, and polyolefin based resins (for example, polyethylene, polypropylene).

The above noted dye binder resins are preferably used in an amount of about 80 to 600 parts by weight per 100 parts by weight of dye, for example.

Any of conventional ink solvents can be used freely in the present invention as the ink solvent in which the above noted dyes and binder resins are dissolved or dispersed.

The inclusion of release agents in the layers constituting the dye donating materials and/or image receiving materials, and especially in the outermost layers at the surfaces where the two types of materials are brought into contact, is preferred for improving the release properties of the thermal transfer dye donating materials and thermal transfer image receiving materials in the present invention.

Known release agents, for example solids or waxes, such as polyethylene wax, amide wax and Teflon powder, for example; fluorine based or phosphate ester based surfactants, for example; and paraffin based, silicone based and fluorine based oils, can all be used as release agents in the present invention, but the use of silicone oils is preferred.

Modified silicone oils, such as the carboxy modified, amino modified and epoxy modified silicone oils, can be used as well as the unmodified silicone oils. Examples of such modified oils include the various modified silicone oils described on pages 6 to 18B of the Shinetsu Silicone Company's data sheet entitled "Modified Silicone Oils", (Mar. 3, 1987). The use of amino modified silicone oils which have groups which can undergo a reaction with the crosslinking agent for the binder (for example, groups which can react with isocyanates) are effective when an organic solvent soluble binder is used, while in cases where the oil is to be emulsified and dispersed in a water soluble binder, the use of a carboxy modified silicone oil (for example, the silicone oil of trade name X-22-3710, made by the Shinetsu Silicone Co.) is effective.

Any of known supports can be used for the thermal transfer dye donating material. For example, poly(ethylene terephthalate); polyamide; polycarbonate; glassine paper; condenser paper; cellulose ester, fluorinated polymers; polyether; polyacetal; polyolefin; polyamide, poly(phenylene sulfide); polypropylene; polysulfone or cellophane, for example, are useful.

The thickness of the support of the thermal transfer dye donating material is generally from 2 μm to 30 μm. An under-layer may be established, as required. Furthermore, hydrophilic polymer layers for preventing the diffusion of dye can also be provided between the support and the dye donating layer. The transfer density can be improved considerably in this way. The aforementioned water soluble polymers can be used as the hydrophilic polymers.

Furthermore, slipping layers may be provided to prevent the thermal head from sticking to the dye donating material. The slipping layer may be constructed from a lubricating material, for example, a surfactant or a solid or a liquid lubricant, or a mixture of such materials, which may or may not contain a polymer binder.

The layers from which the thermal transfer image receiving material of the present invention and the thermal transfer dye donating material are constructed may be hardened by means of hardening agents.

The hardening agents disclosed, for example, in JP-A-No. 61-199997 and JP-A-No. 58-215398 can be used for hardening organic solvent based polymers. The use of isocyanate based hardening agents is especially desirable for polyester resins.

The hardening agents disclosed, for example, in column 41 of U.S. Pat. No. 4,678,739, JP-A-No. 59-116655, JP-A-No. 62-245261 and JP-A-No. 61-18942 are appropriate for hardening water soluble polymers. In practice, aldehyde based hardening agents (for example, formaldehyde), aziridine based hardening agents, epoxy based hardening agents, vinylsulfone based hardening agents (for example, N,N'-ethylenebis(vinylsulfonylacetamido)ethane), N-methylol based hardening agents (for example, dimethylolurea) and polymeric hardening agents (the compounds disclosed, for example, in JP-A-No. 62-234157) can be used for this purpose.

Anti-color fading agents may be employed in the thermal transfer dye donating material and thermal transfer image receivin.g material. Antioxidants, ultraviolet absorbers and various metal complexes can be used, for example, as anti-color fading agents.

Examples of antioxidants include, for example, chroman based compounds, coumaran based compounds, phenol based compounds (hindered phenols, for example), hydroquinone derivatives, hindered amine derivatives and spiroindane based compounds. The compounds disclosed in JP-A-No. 61-159644 are also effective.

Benzotriazole based compounds (for example, U.S. Pat. No. 3,533,794), 4-thiazolidone based compounds (for example, U.S. Pat. No. 3,352,681), benzophenone based compounds (for example, JP-A-No. 56-2784) and the other compounds disclosed, for example, in JP-A-No. 54-48535, JP-A-No. 62-136641 and JP-A-No. 61-88256, can be used, for example, as ultraviolet absorbers. Furthermore, the ultraviolet absorbing polymers disclosed in JP-A-No. 62-260152 are also effective as ultraviolet absorbers.

The compounds disclosed, for example, in U.S. Pat. No. 4,241,155, columns 3 to 36 of U.S. Pat. No. 4,245,018, columns 3 to 8 of U.S. Pat. No. 4,254,195, JP-A-No. 62-174741, pages 27 to 29 of JP-A-No. 61-88256, Japanese Patent Application Nos. 62-234103 and 62-31096 (corresponding to JP-A-No. 1-75568 and JP-A-No. 63-199248, respectively), and Japanese Patent Application No. 62-230596 can be used as the metal complexes.

Examples of useful anti-color fading agents have been disclosed on pages 125 to 137 of JP-A-No. 62-215272.

Anti-color fading agents for preventing the fading of dyes which have been transferred to the image receiving material may be included in the image receiving material beforehand, or may be supplied to the image receiving material from the outside, using a method involving transfer from the dye donating material, for example.

The above noted antioxidants, ultraviolet absorbers and metal complexes may be used in combination thereof.

Fluorescent whiteners may be used in the thermal transfer image receiving material. Examples of such materials include the compounds disclosed in Chapter 8 of *The Chemistry of Synthetic Dyes* by K. Veenkataraman, and in JP-A-No. 61-143752. Useful fluorescent whiteners include stilbene based compounds, coumarin based compounds, biphenyl based compounds, benzoxazolyl based compounds, naphthalimide based compounds, pyrazoline based compounds, carbostyril based compounds and 2,5-dibenzoxazolethiophene based compounds.

The fluorescent whiteners can be used in combination with anti-color fading agents.

Various surfactants can be used in the layers of the thermal transfer dye donating material and thermal transfer image receiving material are either as coating promotors, to improve peeling properties, to improve slip properties, to provide anti-static properties or to accelerate development, for example.

For example, use can be made of nonionic surfactants, anionic surfactants, amphoteric surfactants and cationic surfactants. Examples of such surfactants are disclosed, for example, in JP-A-No. 62-173463 and JP-A-No. 62-183457.

Organic fluoro compounds can be included in the thermal transfer dye donating material and thermal transfer image receiving material to improve slip properties, to provide anti-static properties and to improve the peeling properties, for example. Typical examples of useful organic fluoro compounds include the fluorine based surfactants disclosed, for example, in columns 8 to 17 of JP-B-No. 57-9053, JP-A-No. 61-20944 and JP-A-No. 62-135826, and hydrophobic fluorine based compounds such as the oil like fluorine based compounds, for example fluorine oils, and the solid fluorine based resins, for example tetrafluoroethylene resins. (The term "JP-B" as used herein means an "examined Japanese patent publication".)

Matting agents can be used in the thermal transfer dye donating material and thermal transfer image receiving material. Compounds such as the benzoguanamine resin beads, polycarbonate resin beads and AS resin beads disclosed in Japanese Patent Application Nos. 62-110064 and 62-110065 (corresponding to JP-A-No. 63-274944 and JP-A-No. 63-274952, respectively) can be used for this purposes as well as the compounds such as silicon dioxide, polyolefins and polymethacrylates disclosed on page 29 of JP-A-No. 61-88256.

In the present invention, a thermal transfer dye donating material is laminated with a thermal transfer image receiving material. The dye of the dye donating layer is transferred to the thermal transfer image receiving material in accordance with the magnitude of the applied thermal energy. Thermal energy corresponding to an image signal is applied by means of a heating device such as a thermal head to either side of the laminate, but preferably to the reverse side of the thermal transfer dye donating material. Color images having excellent sharpness and gradation of resolution are obtained in this way.

The heating means is not limited to a thermal head, and other known methods of heating with laser light (with a semiconductor laser, for example), infrared flash and thermal pens, for example, can be used for this purpose.

It is possible to obtain print and facsimile copy using various types of thermal printers, to form prints of images with magnetic recording systems, photomagnetic recording systems, or photorecording systems, and to form prints from television and CRT screens, for example, by combining a thermal transfer dye donating material with the thermal transfer image receiving material of the present invention.

JP-A-No. 60-34895 discloses details of useful thermal transfer recording methods.

The present invention is described in more detail below by means of the following nonlimiting examples.

EXAMPLE 1

Preparation of Thermal Transfer Dye Donating Material (A)

A poly(ethylene terephthalate) film having a thickness of 5.5 μm ("Lumilar", made by Toray) and a heat resistant slip layer consisting of a thermoset acrylic resin provided on one side thereof, was used as a support. The coating composition (A) for thermal transfer dye donating layer formation, the composition of which is indicated below, was coated by wire bar coating to provide a dry film thickness of 2 μm onto the side of the support opposite that having the heat resistant slip layer, to obtain the thermal transfer dye donating material (A).

| Coating Composition (A) for Thermal Transfer Dye Donating Layer | |
|---|---|
| Dispersible dye (1,4-diamino-2,3-diphenoxyanthraquinone) | 4 grams |
| Poly(vinyl butyral) resin ("Denka Butyral 5000-A", made by Denki Kagaku) | 4 grams |
| Methyl ethyl ketone | 40 ml |
| Toluene | 40 ml |
| Polyisocyanate ("Takenate D110N", made by Takeda Yakuhin) | 0.2 ml |

Preparation of Thermal Transfer Image Receiving Material (1)

Synthetic paper of thickness 150 μm (YUPO-FPG-150, made by Oji Yuka) was used as a support. The coating composition for the image receiving layer, the composition of which is indicated below, was coated by wire bar coating to provide a dry thickness of 10 μm on one side of the above noted support to prepare thermal transfer image receiving material (1). Drying was carried out by means of preliminary drying in a drier at a room temperature, followed by drying for 30 minutes in an oven at a temperature of 100° C.

| Coating Composition for Image Receiving Layer | |
|---|---|
| Polyester resin No. 1 | 20 grams |
| Amino modified silicone oil ("KF-857", made by Shinetsu Silicone) | 0.5 gram |
| Epoxy modified silicone oil ("KF-100T", made by Shinetsu Silicone) | 0.5 gram |
| Methyl ethyl ketone | 85 ml |
| Toluene | 85 ml |
| Cyclohexanone | 30 ml |

Thermal transfer image receiving materials (2) and (3) of the present invention, and comparative thermal transfer image receiving materials (a) to (c), as shown in Table 1, were prepared by substituting the resin as indicated in Table 1.

The thermal transfer dye donating material and the thermal transfer image receiving materials obtained as described above were laminated together with the dye donating layer in contact with the image receiving layer in each case, and printing was carried out from the support side of the thermal transfer dye donating layer using a thermal head under conditions of thermal head output 0.25 W/dot, pulse width 0.15 to 15 msec., dot density 6 dots/mm. .The image receiving layers of the thermal transfer image receiving materials were imagewise dyed with the magenta dye.

The reflection densities of the parts of the recorded thermal transfer image receiving materials at which the density was saturated ($D_{max}$) thus obtained were measured using a status A filter, and the results obtained are shown in Table 1.

Furthermore, the recorded thermal transfer image receiving materials thus obtained were stored for 1 month in an incubator at 60° C. and examined for image blurring by observing them by the eyes. The adhesion of the image receiving layer was evaluated by forming 6 cuts with a spacing of 5 mm both laterally and transversely on the image receiving surface to provide a pattern of 25 squares, attaching sticky tape ("Scotch Mending Tape", made by Sumitomo 3M) over the top and then quickly peeling off the tape in a direction at 180° with respect to the flat surface of the image receiving sample. The strength of adhesion was thereby assessed in terms of the number of squares which were peeled away. The adhesion was good where the number of squares removed was not more than 5 out of 25, and considered to be poor where 6 or more of the 25 squares were removed. The results obtained are shown in Table 1.

TABLE 1

| Image Receiving Material | Sample Designation | Resin | Reflection Density | Blurring | Adhesion |
|---|---|---|---|---|---|
| (1) | Invention | No. 1 | 1.8 | little | good |
| (2) | Invention | No. 2 | 1.9 | little | good |
| (3) | Invention | No. 3 | 2.0 | little | good |
| (a) | Comp. Ex. | a* | 1.7 | remarkable | poor |
| (b) | Comp. Ex. | b* | 1.8 | remarkable | poor |
| (c) | Comp. Ex. | c* | 1.5 | a little | good |

Moreover, the resins a, b and c were polyester resins having the compositions indicated below.

| *Resin | TPA | IPA | SIPA | BIS-A-ED | EG | NPG |
|---|---|---|---|---|---|---|
| a | 25 | 25 | — | — | 25 | 25 |
| b | 25 | 25 | — | 25 | 25 | — |
| c | 23.5 | 23.5 | 3 | — | 25 | 25 |

(NPG = neopentyl glycol)

It is clear from Table 1 that there was little blurring of the image and good adhesion to the support when the polyester resin c which contained $SO_3^{\theta}$ anionic groups was used, but an adequate color density was not obtained in this case. With polyester resin b which contained bisphenol A having phenylene groups on the linear chain, the image density was comparatively high, but image blurring tended to occur, and adhesion to the support was poor. On the other hand, the polyester resins 1, 2 and 3 which contained anionic groups and contained phenylene groups on the linear chain, i.e., the resin for use in the present invention, gave high image densities with little image blurring and good adhesion to the support.

EXAMPLE 2

Thermal transfer image receiving material (4) was prepared in the same way as the thermal transfer image receiving materials were prepared in Example 1, except that the coating composition for image receiving layer was modified as indicated below.

| Coating Composition for Image Receiving Layer | |
|---|---|
| Polyester resin No. 3 | 24 grams |
| Polyester resin a | 12 grams |
| Amino modified silicone oil ("KF-857", made by shinetsu Silicone) | 1 gram |
| Polyisocyanate ("KP-90", made by Dainippon Ink) | 6 grams |
| Methyl ethyl ketone | 85 ml |
| Toluene | 85 ml |
| Cyclohexanone | 30 ml |

The results show that images having a high maximum density and which exhibited little blurring were obtained using a polyester resin outside the scope of the present invention conjointly with a polyester resin of the present invention.

EXAMPLE 3

Preparation of Thermal Transfer Dye Donating Material (B)

The coating composition for the thermal transfer dye donating layer, the composition of which is indicated below, was coated to provide a dry film thickness 1.5 μm onto the one side of a poly(ethylene terephthalate) film of thickness 6 μm on one side of which film a heat resistant slip layer bad been provided, which side was opposite to that having the heat resistant slip layer, to provide the thermal transfer dye donating material (B).

| Coating Composition for Thermal Transfer Dye Donating Layer | |
|---|---|
| Dispersible dye a (*) | 5 grams |
| Poly(vinyl butyral) | 3 grams |
| Polyisocyanate ("Takenate D110N", made by Takada Yakuhin)) | 0.15 ml |
| Methyl ethyl ketone | 35 ml |
| Tolune | 45 ml |

(*): Dispersible Dye a

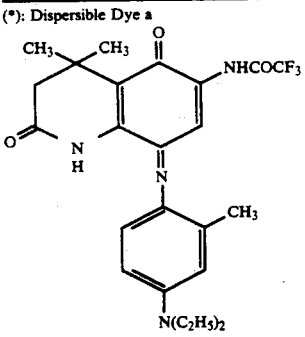

Preparation of Thermal Transfer Image Receiving Material (5)

A high density polyethylene film of thickness 15 μm was laminated on one side of a top quality paper of thickness 170 μm, and low density polyethylene film of thickness 5 μm was laminated on the other side of the paper.

Moreover, 10 wt % of titanium dioxide and 0.4 wt % of a bluish pigment were included in the high density polyethylene. Gelatin was coated in a thickness of 0.2 μm on the side laminated with high density polyethylene, and gelatin which contained silica-alumina ($SiO_2$—$Al_2O_3$) was coated to a thickness of 0.2 μm on the side laminated with the low density polyethylene.

The coating composition for the image receiving layer, the composition of which is indicated below, was coated by wire bar coating to provide a dry thickness of 10 μm over the gelatin layer on the side laminated with the high density polyethylene and dried to prepare thermal transfer image receiving material (5).

| Coating Composition for Image Receiving Layer | |
|---|---|
| Polyester resin No. 4 | 25 grams |
| Amino modified silicone oil ("KF-857", made by shinetsu Silicone) | 0.8 gram |
| Polyisocyanate ("KP-40", made by Dainippon Ink) | 4 grams |
| Methyl ethyl ketone | 100 ml |
| Toluene | 100 ml |

Furthermore, thermal transfer image receiving materials (6), (7) and (d) were prepared in the same manner, except that the polyester resin was substituted as indicated in Table 2.

Thermal transfer was carried out in the same way as in Example 1 using the above described materials, and the performance thereof was likewise evaluated.

TABLE 2

| Image Receiving Material | Resin | Reflection Density | Blurring | Adhesion |
|---|---|---|---|---|
| (5) | No. 4 | 2.0 | little | good |
| (6) | No. 9 | 1.9 | little | good |
| (7) | No. 11 | 1.85 | little | good |
| (d) | a | 1.6 | remarkable | poor |

It is clear from Table 2 that images having a high reflection density and little blurring and good adhesion between the image receiving layer and the support are obtained, when a polyester resin of the present invention is used.

While the invention has been described in detail and with reference to specific embodiments thereof, it will be apparent to one skilled in the art that various changes and modifications can be made therein without departing from the spirit and scope thereof.

What is claimed is:

1. A thermal transfer image receiving material comprising a support having thereon at least one dye imaging receiving layer containing a polyester resin, said polyester resin containing units derived from dicarboxylic acid components and diol components, said units derived from dicarboxylic acid components comprising units containing an anionic $SO_3^{\theta}$ group in an amount of from 0.1 to 20 mol % of the total units derived from dicarboxylic acid components, and said units derived from diol components comprising units containing a phenylene group, wherein said anionic $SO_3^{\theta}$ groups and phenylene groups are contained in the linear chain portion of the resin.

2. A thermal transfer image receiving material as in claim 1, wherein the units containing phenylene groups derived from diol components constitute from 5 to 100 mol % of the total units derived from diol components.

3. A thermal transfer image receiving material as in claim 1, wherein the polyester resin is coated in an amount of from 1 gram to 100 grams per square meter of the support.

4. A thermal transfer image receiving material as in claim 1, wherein said units derived from dicarboxylic acid components consist of units derived from terephthalic acid and isophthalic acid, and units containing an anionic $SO_3^{\theta}$ group.
5. A thermal transfer image receiving material as in claim 1, wherein said units containing an anionic $SO_3^{\theta}$ group are selected from
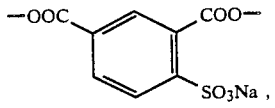
-continued
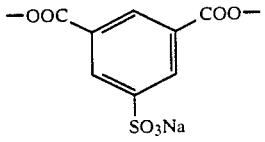
and
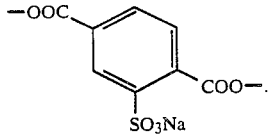
* * * * *